US007060917B1

(12) United States Patent
Park

(10) Patent No.: US 7,060,917 B1
(45) Date of Patent: Jun. 13, 2006

(54) PLUNGER SWITCH FOR ELECTRIC APPLIANCES

(75) Inventor: Chul Hee Park, Seoul (KR)

(73) Assignee: Park Electronics Co., Ltd., Seoul (KR)

( * ) Notice: Subject to any disclaimer, the term of this patent is extended or adjusted under 35 U.S.C. 154(b) by 0 days.

(21) Appl. No.: 11/133,615

(22) Filed: May 20, 2005

(51) Int. Cl.
*H01H 21/54* (2006.01)
*H01H 13/00* (2006.01)

(52) U.S. Cl. ..... 200/16 B; 200/329; 200/520

(58) Field of Classification Search ..... 200/16 B, 200/16 C, 17 R, 341, 520, 329, 243, 530, 200/521, 534, 250
See application file for complete search history.

(56) References Cited

U.S. PATENT DOCUMENTS 5,929,407 A * 7/1999 Ziem ..... 200/61.89
6,720,510 B1 * 4/2004 Passow ..... 200/243
6,861,595 B1 * 3/2005 Passow ..... 200/16 R
6,880,226 B1 * 4/2005 McGill et al. ..... 29/592.1

* cited by examiner

*Primary Examiner*—Lincoln Donovan
*Assistant Examiner*—Lheiren Mae A. Anglo
(74) *Attorney, Agent, or Firm*—John K. Park; Park Law Firm

(57) ABSTRACT

Disclosed herein is a plunger switch for electric appliances, which is mounted to an electric appliance to control a lamp, a motor, a heater, etc. and has enhanced safety and electrical and mechanical properties, thus maintaining the original condition of the switch without reduction of elasticity or deformation of the switch, even if the switch is repeatedly used. Thereby, the operational reliability is increased and malfunctions caused by arc discharge are prevented. Unlike the sliding structure which does not use another separate contact point, this invention can be adapted to a high-current or high-temperature switch. Further, this invention has a hook, thus allowing easy assembly and replacement of the plunger switch to a proper position on an electric appliance.

3 Claims, 5 Drawing Sheets

[FIG1]
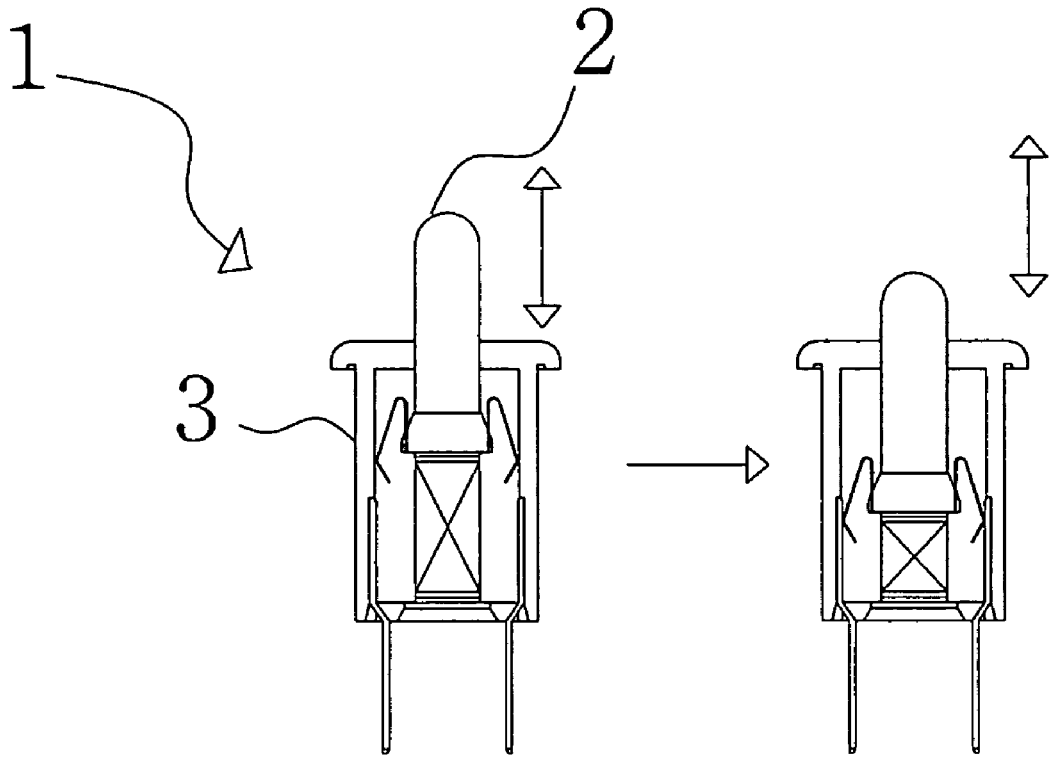

[FIG2]
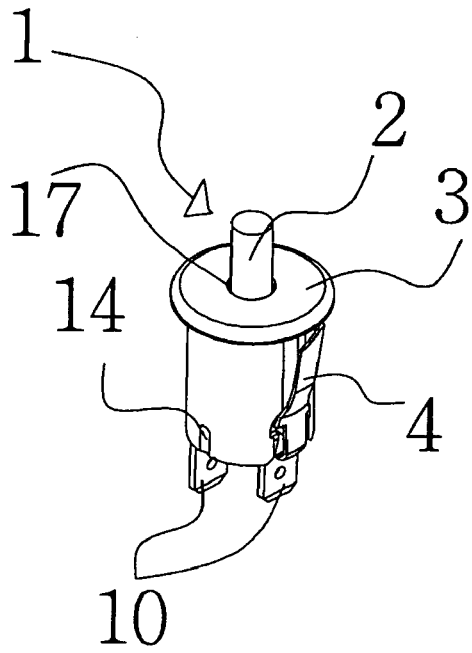
[FIG3]
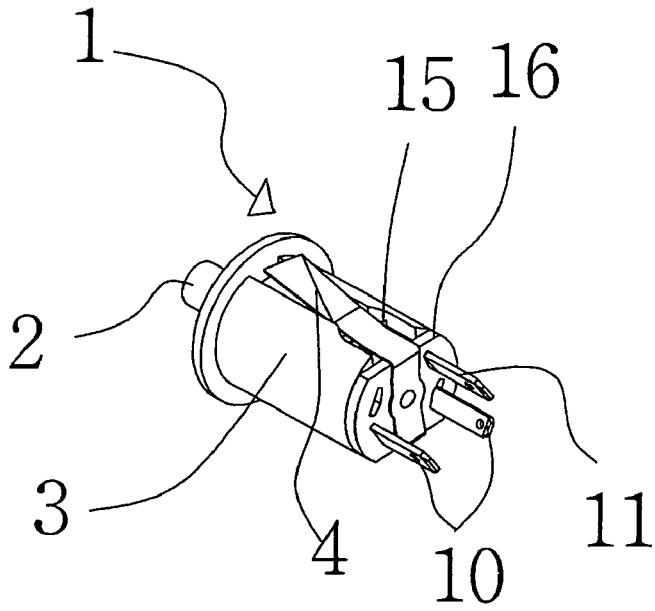

[FIG4]
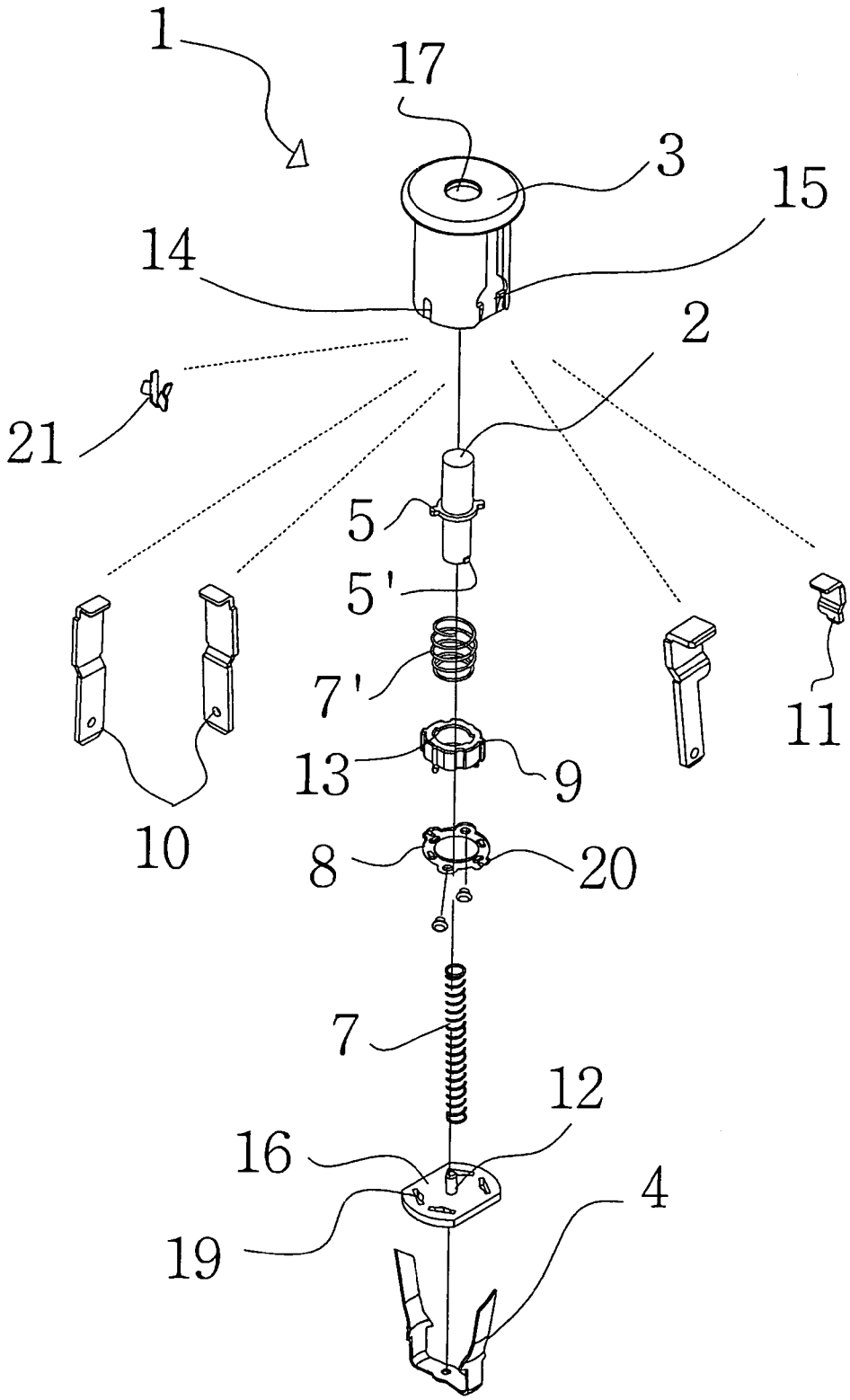

[FIG 5a]
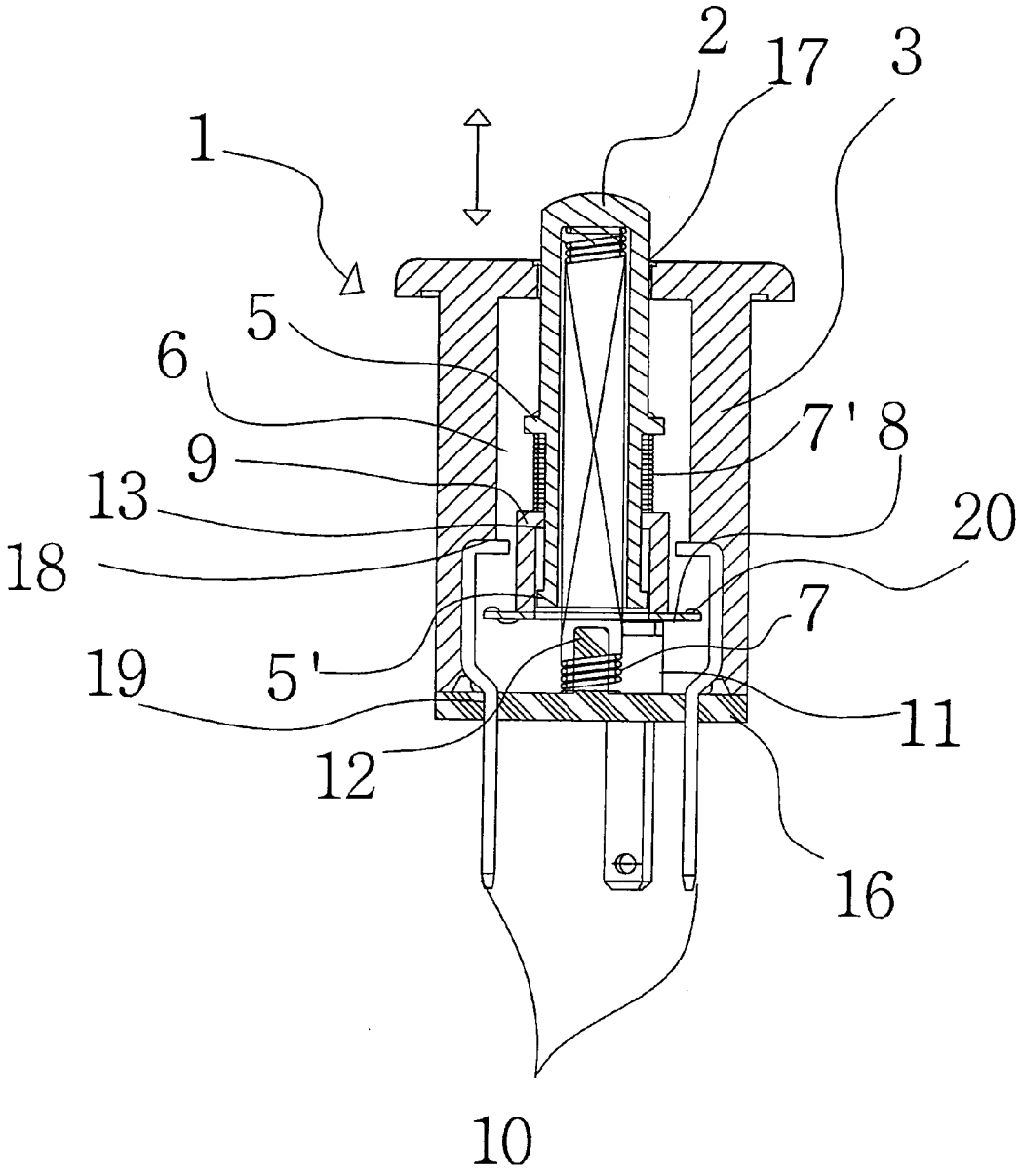

[FIG 5b]
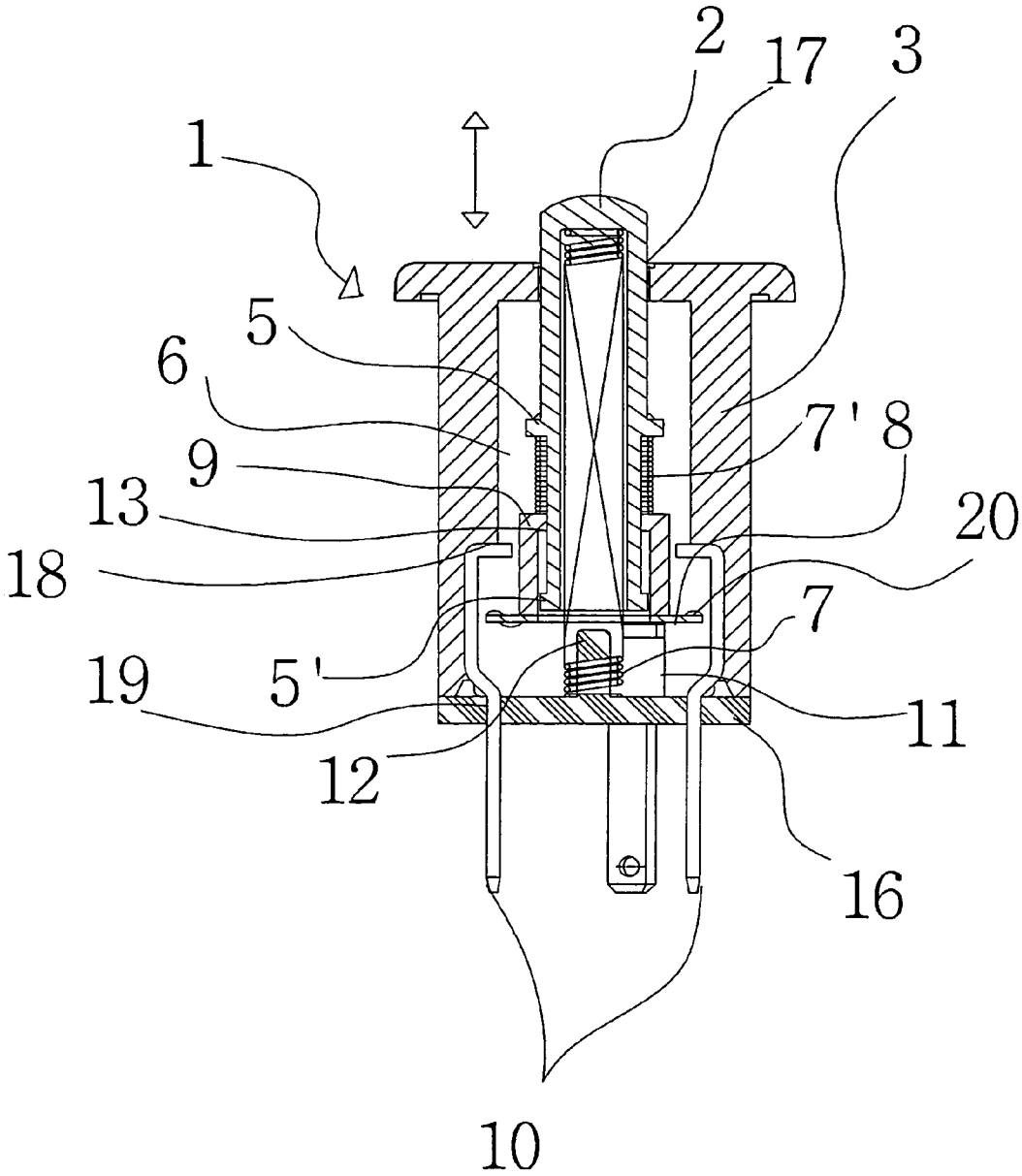

PLUNGER SWITCH FOR ELECTRIC APPLIANCES

BACKGROUND OF THE INVENTION

1. Field of the Invention

The present invention relates generally to a plunger switch and, more particularly, to a plunger switch for electric appliances, which may be mounted to an electric appliance to control a lamp, a motor, a heater, etc. and has enhanced safety and electrical and mechanical properties, thus providing high reliability so that the plunger switch may be safely operated for a lengthy period of time. Further, this invention allows the plunger switch to maintain its original condition without a reduction in elasticity or a change of shape, despite being repeatedly used.

2. Description of the Related Art

Generally, a plunger switch is mounted to an electric appliance to control a lamp, a motor, a heater, etc. Due to external pressure generated by electric and mechanical elements, a point of contact of the plunger switch engages the electric appliance. Meanwhile, when the external pressure is eliminated, the contact of the plunger switch returns to an original position thereof, thus maintaining an operable position.

That is, as shown in FIG. 1, a conventional plunger switch includes a main body 3 having a predetermined shape. A plunger 2 is secured within the main body 3 and protrudes outwards from the main body 3. A locking flange is provided on the plunger 2, so that a W-shaped contact is coupled to the locking flange. Further, a spring is fitted over the portion of the plunger 2 under the locking flange. Thereby, the plunger 2 slides up and down due to external pressure, thus being in electric contact with contacts that are provided on both sides of an inner surface of the main body 3.

However, the plunger switch 1, mounted to an electric appliance to control a lamp, a motor, a heater, etc., is problematic in that the elastic force of the spring may be reduced, the sliding contact may be deformed, and an arc discharge may occur, due to long use and repeated operation of the plunger switch 1, thus eventually causing repeated malfunctions.

The plunger switch 1 has another problem in that it has a sliding structure, so that the switch is not stably operated, and the switch may malfunction.

Further, it is impossible to adapt an additional contact point to the plunger switch having the sliding structure, so that the plunger switch cannot be used as a switch for a high-current electric appliance.

SUMMARY OF THE INVENTION

Accordingly, the present invention has been made keeping in mind the above problems occurring in the prior art, and an object of the present invention is to provide a plunger switch for electric appliances, which has high reliability so that it is stably operated for a lengthy period of time, and which prevents the deformation of a contact and the malfunction of the switch due to arc discharge, when a plunger repeatedly slides up and down due to external pressure, and which allows an additional contact point to be provided to the switch, thus being suitable for a high-current switch.

In order to accomplish the above object, the present invention provides a plunger switch for electric appliances, including a main body, a bushing, a plunger, a plate, a cover, a hook, and a connection terminal. The main body has a predetermined shape, and includes a plunger hole provided on an upper surface of the main body and supporting a plunger such that the plunger moves up and down, with a lower portion of the main body being open, a space defined in the main body, a step provided on the space to support normally closed contacts, a terminal insertion slot provided at a predetermined position on an end of an outer surface of the main body such that a connection terminal is inserted into the terminal insertion slot, and a hook locking hole provided at a predetermined position on the outer surface of the main body to engage with a hook. The bushing is inserted into the main body through an opening provided on the lower portion of the main body to support the plunger, and includes a locking part to cause the bushing to move up and down along with the plunger. The plunger is inserted into the plunger hole of the main body through the bushing, with a first spring being inserted into the plunger in a lengthwise direction, and includes first and second stoppers provided at a middle position and an end of the plunger, respectively, with a second spring fitted over a portion between a top of the bushing and the first stopper provided at the middle position of the plunger. The first spring, inserted into the plunger, passes through a center of the plate to close a bottom of the bushing. The plate is attached to the plate to be in contact with the contacts. The cover closes the opening of the main body, and includes contact holes to support the normally closed contacts and the normally open contacts in such a way that the contacts come into contact with the plate, and a spring support protrusion provided on a center of the cover to support the first spring inserted into the plunger. The hook engages with the hook locking hole provided on the outer surface of the main body, thus firmly fastening the cover to the main body. The connection terminal is inserted into a terminal insertion slot to connect the normally closed contacts with the normally open contacts that are positioned in the main body, whereby the plate is elastically moved up and down to come into contact with the contacts by the plunger which is supported by both the main body and the bushing and moves up and down.

BRIEF DESCRIPTION OF THE DRAWINGS

The above and other objects, features and advantages of the present invention will be more clearly understood from the following detailed description taken in conjunction with the accompanying drawings, in which:

FIG. 1 is a sectional view showing a conventional plunger switch;

FIG. 2 is a perspective view of a plunger switch, according to the present invention;

FIG. 3 is a perspective view showing the bottom of the plunger switch, according to this invention;

FIG. 4 is an exploded perspective view of the plunger switch, according to this invention; and FIGS. 5*a* and 5*b* are sectional views showing the operation of the plunger switch, according to this invention.

DESCRIPTION OF THE PREFERRED EMBODIMENTS

Hereinafter, the preferred embodiment of this invention will be described in detail with reference to the accompanying drawings.

FIG. 2 is a perspective view of a plunger switch, according to the present invention, FIG. 3 is a perspective view showing the bottom of the plunger switch, according to this invention, and FIG. 4 is an exploded perspective view of the plunger switch, according to this invention.

A plunger switch 1 having improved electrical and mechanical properties is adapted to an electric appliance to mechanically control a lamp, a motor, a heater, etc. According to this invention, the plunger switch 1 includes a main body 3 made of a hard synthetic resin material, a plunger 2 having stoppers 5 and 5', springs 7 and 7' providing elasticity, a bushing 9, contacts 10 and 11, a cover 16, and a hook 4. The above-mentioned elements are sequentially assembled with each other, so that the plunger switch 1 is elastically operated.

The main body 3 of the plunger switch 1 has a cylindrical shape. A plunger hole 17 is formed on a center of the top of the main body 3, and supports the plunger 2 so that the plunger 2 moves up and down. A lower portion of the main body 3 is open. Further, a space 6 is defined in the main body 3, and a step 18 is provided on the inner circumferential surface of the space 6 to support the upper end of each of a plurality of normally closed contacts (NC contacts) 10.

Further, a terminal insertion slot 14 is provided on an end of the main body 3, so that a connection terminal 21 is inserted into the terminal insertion slot 14 so as to connect the NC contacts 10 and normally open contact (NO contact) 11, which are inserted into the main body 3. Hook locking holes 15 are provided on predetermined portions of the main body 3 around the terminal insertion slot 14 to firmly fasten the cover 16 to the main body 3.

A cylindrical bushing 9 is disposed in the space 6 of the main body 3. A locking part 13 is provided on the bushing 9 to cause the bushing 9 to move up and down along with the plunger 2 which is inserted into the space 6 through the opening provided on the lower portion of the main body 3.

The plunger 2 passes through the lower end of the bushing 9 which is inserted into the main body 3. A spring 7 is longitudinally inserted into the cylindrical plunger 2, and stoppers 5 and 5' are provided at a middle portion and a lower end of the outer circumferential surface of the plunger 2.

Thus, after the plunger 2 passes through the lower end of the bushing 9, the plunger 2 is inserted into the center of the upper surface of the main body 3. The stopper 5' provided at the lower end of the plunger 2 is stopped by the locking part 13 which is provided on the inner circumferential surface of the bushing 9. Further, the stopper 5 provided at the middle portion of the plunger 2 is stopped by the lower end of the plunger hole 17 of the main body 2, during elastic actuation.

Another spring 7' is provided between the top of the bushing 9 and the stopper 5 positioned at the middle portion of the plunger 2. The spring 7' provides maximum elasticity, like the spring 7 inserted into the plunger 2, and compresses the bushing 9, when the plunger 2 moves up and down.

Further, a plate 8 is attached to the bottom of the bushing 9. When the spring 7 inserted into the plunger 2 passes through the center of the plate 8, the plate 8 closes the bottom of the bushing 9. Further, the plate 8 selectively comes into contact with the contacts 10 and 11. When the plunger 2 moves up and down together with the bushing 9, the plate 8 is operated in conjunction with the springs 7 and 7' and the stoppers 5 and 5'. A plurality of protuberances 20 is provided along the outer circumferential surface of the plate 8 at regular intervals.

While the plate 8 moves up and down, an end of each of the NC contacts 10 is supported by the step 18 which is provided on the inner surface of the main body 3. The end of each of the NC contacts 10 is bent such that the NC contacts 10 may come into contact with the plate 8. Meanwhile, the NO contact 11 are positioned under the NC contact 10 such that there is a height difference between the NO contact 11 and the NC contacts 10.

In order to support the contacts 10 and 11, the plunger 2, the spring 7 inserted into the plunger 2, and the bushing 9, in the main body 3, the cover 16 is secured to the lower portion of the main body 3 to close the opening of the main body 3.

The cover 16 is provided with contact holes 19, so that the NC contacts 10 and the NO contact 11 are inserted into the contact holes 19 in such a way as to be exposed to the outside. Further, a spring support protrusion 12 is provided on the center of the cover 16 to support the spring 7 which is inserted into the plunger 2 to maximize elasticity.

Further, the connection terminal 21 is inserted into the terminal insertion slot 14 to connect the NC contacts 10 and the NO contact 11 which are provided at different positions in the main body 3.

In order to firmly fasten the cover 16 to the main body 3, hook pieces of the hook 4 engage with the corresponding hook locking holes 15 provided on the outer circumferential surface of the main body 3. The hook pieces tightly engage with the holes 15 at a position where the main body 3 is in close contact with the cover 16. Intervals between the hook pieces and the main body 3 increase in a direction from the bottom to the top of the main body 3, so that the hook pieces serve as elastic pieces. Thereby, the hook pieces allow the plunger switch 1 to be firmly fitted into an electric appliance. Further, when the plunger switch is mounted on a panel of the electric appliance, a clicking sound is generated. The hook 4 provides for easy assembly and replacement of the switch 1 in the front of the electric appliance.

FIGS. 5*a* and 5*b* are sectional views illustrating the operation of the plunger switch 1, according to this invention.

According to this invention, the plunger switch 1 is mounted to a predetermined position of an electric appliance, and confirms whether a lamp, a motor, a heater or the like is operating, and has enhanced electrical and mechanical properties, thus increasing the safety of the switch. To this end, when the plunger 2 is retracted into the main body 3 by external pressure, the spring 7' is compressed to push the bushing 9, so that the bushing 9 pushes the plate 8. Thereby, the plate 8 comes into contact with the NO contact 11. Consequently, the switch is changed from the closed state to the open state.

At this time, the spring 7 inserted into the plunger 2 is compressed by the cover 16. In such a state, when the external pressure is eliminated, the plunger 2 will be moved upwards by restoring force.

Therefore, when the external pressure is released, the compressed springs 7 and 7' move outwards in an axial direction, so that the plunger 2 is pushed outwards. Thus, the stopper 5 provided at the middle portion of the plunger 2 comes into contact with the lower end of the plunger hole 17. Simultaneously, the stopper 5' provided at the lower end of the plunger 2 pushes up the locking part 13 of the bushing 9. Thus, the spring 7' compressed against the bushing 9 is returned to an original position thereof by the restoring force of the spring 7'. Thereby, the plate 8 is separated from the NO contact 11 and moves up to come into contact with the NC contacts 10.

As described above, the present invention provides a plunger switch, which does not use a sliding structure but uses a plate structure, thus having enhanced electrical and mechanical properties and increasing the safety of the switch, therefore maintaining the original condition of the switch without reduction of elasticity or deformation of the switch, even if the switch is repeatedly used. Thereby, the operational reliability is increased and malfunctions caused by arc discharge are prevented. Unlike the sliding structure which does not use another separate contact point, this invention can be adapted to a high-current or high-temperature switch. Further, this invention has a hook, thus allowing easy assembly and replacement of the plunger switch to a proper position on an electric appliance.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A plunger switch for electric appliances, comprising:

a main body having a predetermined shape, and comprising:

a plunger hole provided on an upper surface of the main body, and supporting a plunger such that the plunger moves up and down, with a lower portion of the main body being open;

a space defined in the main body;

a step provided on the space to support normally closed contacts;

a terminal insertion slot provided at a predetermined position on an end of an outer surface of the main body such that a connection terminal is inserted into the terminal insertion slot; and a hook locking hole provided at a predetermined position on the outer surface of the main body to engage with a hook;

a bushing inserted into the main body through an opening provided on the lower portion of the main body to support the plunger, and comprising:

a locking part to cause the bushing to move up and down along with the plunger;

the plunger inserted into the plunger hole of the main body through the bushing, with a first spring being inserted into the plunger in a lengthwise direction, and comprising:

first and second stoppers provided at a middle position and an end of the plunger, respectively, with a second spring fitted over a portion between a top of the bushing and the first stopper provided at the middle position of the plunger;

a plate, with the first spring, inserted into the plunger, passing through a center of the plate to close a bottom of the bushing, and comprising:

a contact part attached to the plate to allow the plate to be in contact with the contacts;

a cover to close the opening of the main body, and comprising:

contact holes to support the normally closed contacts and a normally open contact in such a way that the contacts come into contact with the plate; and a spring support protrusion provided on a center of the cover to support the first spring inserted into the plunger;

a hook to engage with the hook locking hole provided on the outer surface of the main body, thus firmly fastening the cover to the main body; and a connection terminal inserted into a terminal insertion slot to connect the normally closed contacts with the normally open contacts that are positioned in the main body, whereby the plate is elastically moved up and down to come into contact with the contacts by the plunger which is supported by both the main body and the bushing and moves up and down.

2. The plunger switch as set forth in claim 1, wherein a plurality of protuberances is provided along an outer circumferential surface of the plate at regular intervals.

3. The plunger switch as set forth in claim 1, wherein the hook engaging with the hook locking hole of the main body has a symmetrical structure to provide elasticity.

* * * * *